United States Patent [19]

Baldwin

[11] 4,200,234

[45] Apr. 29, 1980

[54] HOT AIR SHROUD FOR PAINT SPRAY GUN

[75] Inventor: Jack W. Baldwin, Royal Oak, Mich.

[73] Assignee: General Motors Corporation, Detroit, Mich.

[21] Appl. No.: 953,195

[22] Filed: Oct. 20, 1978

[51] Int. Cl.[2] ..... B05B 1/28

[52] U.S. Cl. ..... 239/296

[58] Field of Search ..... 239/105, 290, 291, 294, 239/296

[56] References Cited

U.S. PATENT DOCUMENTS

| | | | |
|---|---|---|---|
| 2,410,532 | 11/1946 | Tessier | 239/291 |
| 2,504,216 | 4/1950 | Morton | 239/296 |
| 2,644,717 | 7/1953 | Kopperschmidt | 239/290 X |
| 2,814,530 | 11/1957 | Portillo | 239/296 |
| 3,857,511 | 12/1974 | Govindan | 239/296 X |

*Primary Examiner*—Richard A. Schacher
*Attorney, Agent, or Firm*—R. L. Phillips

[57] ABSTRACT

For the application of humidity-sensitive, aqueous-based paint by spray gun, a compact air shroud assembly adapted to be attached to the spray apparatus about the air cap of the gun to envelope the spray with hot, dry air. The air shroud includes inner and outer annular members to define a passage therebetween. Hot, dry air enters the annular space from the bottom in a direction generally normal to the paint spray pattern and is divided into separate flow paths by a baffle below the inner annular member. From the baffle, the separated air flows pass to various segments of the annular space as directed by vanes in the annular passage. The vanes redirect the flow into a direction parallel with the spray pattern.

2 Claims, 3 Drawing Figures

HOT AIR SHROUD FOR PAINT SPRAY GUN

This invention concerns an air shroud assembly adapted to be attached about the spray end of a paint spray gun and provides a shroud of dry, hot air about the paint spray pattern.

The increasing use of aqueous-based paint in the automobile industry present advantages. For example, the clean-up and disposal problems common with painting operations are greatly simplified by the use of this type of paint. However, this paint dries by water evaporation and as a result, high humidity retards drying and thereby increases the chances for runs and sags. The object of the present invention is to provide a compact and efficient air shroud assembly for attachment to the spray gun about the spraying end portion thereof to provide an encircling envelope of dry, hot air about the paint spray pattern.

The subject invention represents an improvement in the state of the art relating to spray guns for aqueous-based paint. U.S. Pat. No. 3,857,511 to Govindan describes a process for the spray application of aqueous paints utilizing an air shroud. Therefore, the Applicant intends to limit his invention to the improved apparatus shown in the drawings and described in detail hereinafter. The Govindan patent discloses in FIG. 1 a somewhat schematically illustrated spray apparatus utilizing air shroud assembly 12 to distribute air through holes 16.

A second patent which may be of interest is U.S. Pat. No. 2,410,532 to Tessier. Two funnel-shaped members 24, 26 forming an annular space or passage 28 therebetween are disclosed. The passage 28 receives compressed air through conduit 42 and the air is distributed about the spray tip 34. Details of the subject air shroud assembly desirable to provide compact and efficient air distribution are not disclosed in this patent.

A third patent of interest is U.S. Pat. No. 2,504,216 to Morton, disclosing a spray gun and air shroud apparatus similar to that of the Tessier patent. An outer funnel member 61 surrounds the spray head of the apparatus to provide an annular channel 62 for the distribution of compressed air about the spray head. The subject compact and efficient device is not disclosed.

A fourth patent of interest is U.S. Pat. No. 2,644,717 to Kopperschmidt. The Kopperschmidt apparatus is a spray gun with a rather clumsy looking tubular air shroud assembly for the spraying of liquids, thermoplastics, molten metal or the like. It is believed that the object of this apparatus is to intermix fluids and not to form an envelope about the spray pattern.

Another patent of general interest is U.S. Pat. No. 2,814,530 to Portillo. The Portillo patent discloses a paint spray apparatus with an air distributing member 24 about the spray tip 12. The object of utilizing an air distributing member appears to be for the purpose of decreasing the fog cloud commonly caused by use of spray guns without adequate ventilation. Nevertheless, apparatus 24 does not disclose the detailed features of the present invention which produce an evenly distributed pattern utilizing a compact air shroud assembly. The subject air shroud apparatus provides a relatively thin assembly easily attached to spray gun apparatus. The subject apparatus includes a generally circular air discharge passage formed between two annular members. Vanes in the space between inner and outer members produce an even flow of air all around the spray pattern and substantially in the same direction. Below the inner member, a baffle is provided which intercepts the hot, dry air entering the air shroud and divides the flow into three paths. The three paths or flows are then separated into right and left paths. These six flow paths are then distributed about the annulus between the inner and outer members by the vanes.

Other advantages and features of the subject apparatus will be more readily apparent from a reading of the following detailed description, reference being had to the accompanying drawings in which a preferred embodiment of the air shroud assembly is illustrated.

IN THE DRAWINGS

Figure 1:
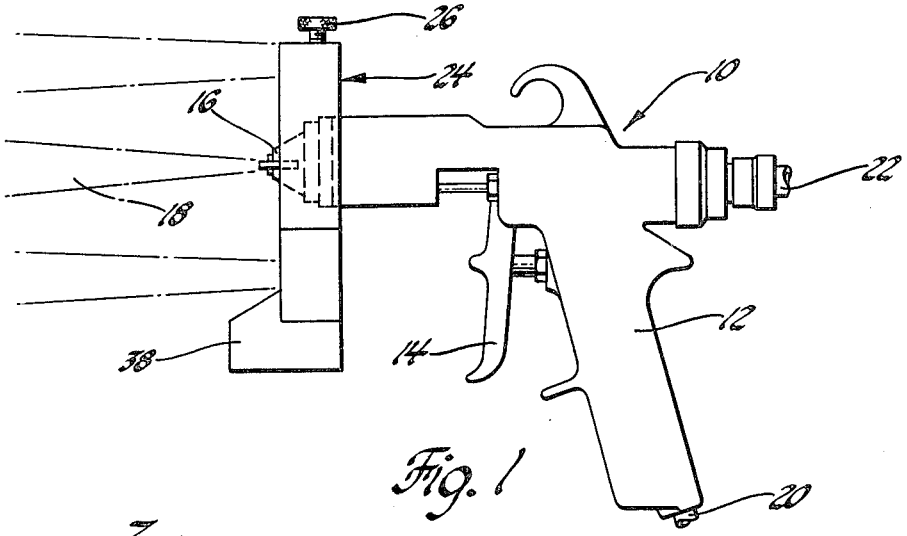
FIG. 1 is an elevational side view of a typical spray gun and the air shroud assembly which is shown in its attached position surrounding the paint spray tip of the gun.
Figure 2:
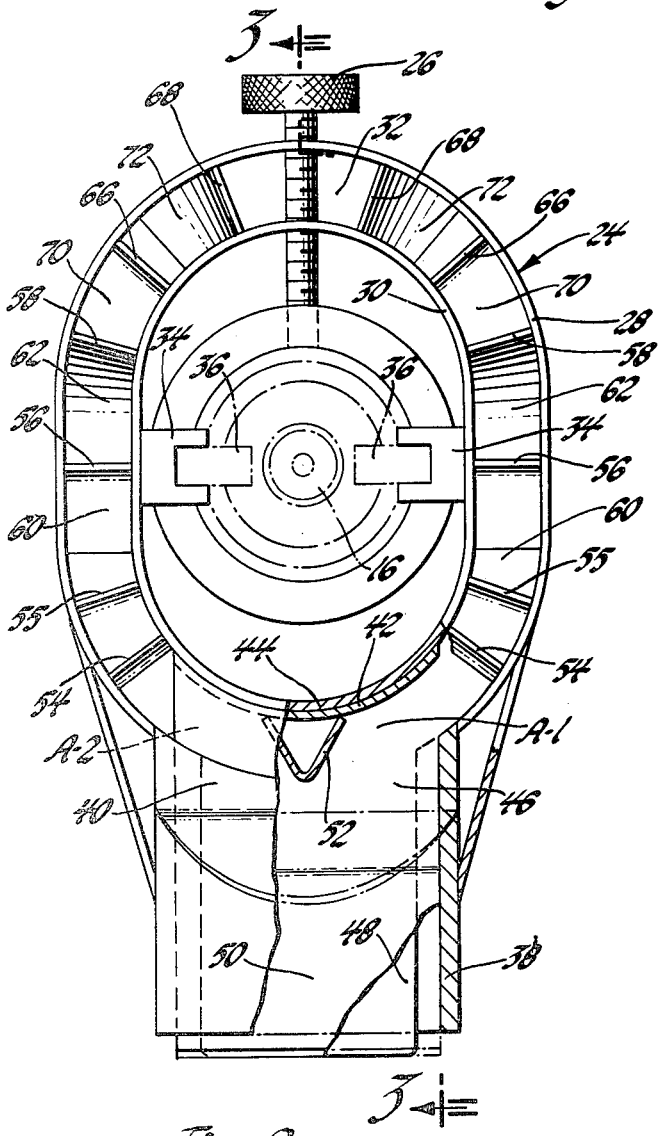
FIG. 2 is an enlarged elevational view of the air shroud assembly showing the annular discharge opening for the hot, dry air.
Figure 3:
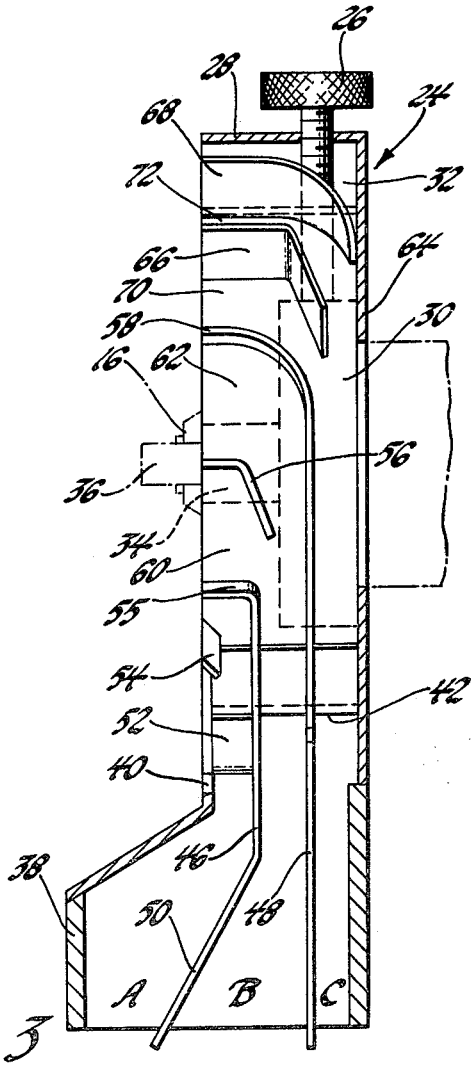
FIG. 3 is a sectional view of the air shroud assembly taken along section line 3—3 in FIG. 2 and looking in the direction of the arrows.

FIG. 1 shows a spray gun 10 which is used for spraying a wide variety of paint, such as enamel, laquer, and aqueous-base paints for which use the present air shroud assembly particularly applies. The spray gun includes body 12 having air and paint passages therein. A trigger 14 controls the application of paint which emerges from a spray nozzle 16 in a generally diverging spray pattern 18. Conduit-like feeds 20 and 22 supply the spray gun 10 with paint and pressurized air. The air shroud housing assembly 24 is positioned about the spray tip 16 and is held in place by a threaded attachment member 26, as best shown in FIGS. 2 and 3. The shroud housing is a thin-walled member and includes an outer annular member 28 and an inner annular member 30 which define annulus or passage 32 therebetween. In FIGS. 2 and 3, it can be seen that the inner member 30 has flange portions 34 on opposed sides adapted to engage winged portions 36 on the spray head or tip 16. The threaded member 26 engages the sprayhead 16 upstream from the tip thereof from which the paint emerges.

The air shroud assembly 24 is supplied a substantial flow of hot, dry air from a source (not shown). The air supply is connected by flexible conduit means to a tubular inlet portion 38 of the housing 24. The inlet portion changes from a circular cross-sectional configuration at a lower end to a generally rectangular throat portion in the vicinity of numeral 40. Within member 38 are baffle means including an arcuate upper wall 42 which corresponds to the arcuate bottom portion 44 of member 30. Depending from the wall 42 are two baffle plates or members 46, 48 which extend interiorly of member 38 and upstream into the air flow. Member 46 includes a straight upper portion and a lower portion 50 extending into the air stream at an inclined angle with respect to the air flow to help smooth the transition between the circular portions 38 and the rectangular portion 40. The members 46 and 48 are flow splitters to divide the flow of air into three separate portions or flows A, B and C, best seen in FIG. 3. The portion A is further split into two subflow portions A-1 and A-2 by wall 42 and, specifically, a V-shaped divider member 52, as shown in FIG. 2. Portions A-1 and A-2 pass to the right and left of the member 52 into a central region of the annulus. The air is then engaged by turning vane members 54 and 55, one of each on either side of member 52. The members 54 and 55 redirect the flow of air from an upward direction normal to the spray pattern 18 into a direction parallel to the flow 18 as is shown in FIG. 1. The central region is above wall 42 and between right and left vanes 55.

Another passage extends between baffle members 46 and 48 and is distributed to either side of the central region of the annulus. Turning vanes 56 and 58 redirect the air from along the sides of the air shroud assembly to a direction parallel to spray 18 to exits through openings 60, 62.

The upper portion of the annular air flow pattern is completed by air in passage C formed between member 48 and the rear wall portion of housing 38. This air flow is guided by member 58 and the apertured rear wall 64 until it engages vanes 66 and 68 which redirect the air flow through respective openings 70 and 72 in a direction parallel to spray pattern 18.

The use of throat baffle members 46, 48 in association with vanes 54, 55, 56, 58, 66 and 68 provides an air shroud having a thin profile and a very efficient and even distribution of air flow in a pattern forming an envelope about the paint spray pattern 18. The arrangement is also particularly well adapted for attachment to a variety of different spray guns, all of which have a generally narrow contoured spray tip against which the fastening member 26 and portions 34 may be engaged.

Although only a preferred embodiment of the air shroud assembly has been illustrated, modifications thereto are contemplated, still falling within the scope of the following claims, which solely define the invention.

The embodiments of the invention in which an exclusive property or privilege is claimed are defined as follows:

1. An improved air shroud assembly adapted to be attached to paint spray apparatus during application of humidity-sensitive, aqueous-based paint for producing a continuous and evenly distributed flow of dry air about the paint spray pattern, the improved shroud assembly comprising:

a thin-walled housing with a tubular portion forming a passage for dry air and an integral mounting portion forming a passage for the paint spray pattern, the portions being oriented one to another so that the direction of dry air flow entering the housing is non-parallel to the direction of the paint spray pattern, the mounting portion having an apertured rear wall for attachment to the spray apparatus about the paint outlet thereof and further having walls defining an annulus framing the spray pattern and through which the flow of dry air passes;

baffle means in the housing for distributing the flow of dry air evenly about the spray pattern and changing the dry air flow direction parallel therewith, said baffle means including a flow-splitting portion formed by walls extending into the dry air flow through the tubular portion, one of the flow-splitting walls directing a portion of the dry air flow to a region central of said annulus, the other of said flow-splitting walls directing dry air to either side of said central region;

vanes in the annulus for redirecting dry air flow to a direction parallel with the paint spray pattern as the dry air emerges from the annulus and for simultaneously distributing the dry air flow evenly about the spray pattern.

2. An improved air shroud assembly adapted to be attached to paint spray apparatus during application of humidity-sensitive, aqueous-based paint for producing a continuous and evenly distributed flow of dry air about the paint spray pattern, the improved shroud assembly comprising:

a thin-walled housing with a lower tubular portion forming a passage for dry air and an integral mounting portion forming a passage for the paint spray pattern, the portions being oriented one to another so that the direction of dry air flow entering the housing is non-parallel to the direction of the paint spray pattern, the mounting portion having an apertured rear wall for attachment to the spray apparatus about the paint outlet thereof and further having walls defining an annulus framing the paint spray pattern and through which the flow of dry air passes;

baffle means in the housing for distributing the flow of dry air evenly about the spray pattern and changing the dry air flow direction parallel therewith, said baffle means including a flow-splitting portion formed by walls depending from an upper wall, the depending walls extending into the dry air flow through the tubular portion, one of which, in cooperation with the tubular portion, directing a portion of the dry air flow against the upper wall and to the right and to the left to a central region of said annulus, a first set of vanes in the central region of the annulus for redirecting dry air flow to a direction parallel with the spray pattern, another of the depending walls directing dry air against said upper wall and to the right and left of the central region, a second set of vanes in the annulus and to either side of said central region for redirecting dry air flow to a direction parallel with the paint spray pattern as the dry air emerges from the annulus and for simultaneously distributing the dry air flow evenly about the paint spray pattern.

* * * * *